US005589657A

United States Patent [19]

Gessel et al.

[11] Patent Number: 5,589,657

[45] Date of Patent: Dec. 31, 1996

[54] DETONATING SYSTEM HAVING A DETONATOR WITHIN AN INSULATING CONTAINER

[75] Inventors: Uwe Gessel, Troisdorf; Rolf Rospek, Edemissen; Helmut Zollner, Meerbusch, all of Germany

[73] Assignee: Dynamit Nobel Aktiengesellschaft, Troisdorf, Germany

[21] Appl. No.: 429,530

[22] Filed: Apr. 26, 1995

[30] Foreign Application Priority Data

Apr. 26, 1994 [DE] Germany ..... 44 14 411.3

[51] Int. Cl.[6] ..... F42C 19/12

[52] U.S. Cl. ..... 102/202.14; 102/301

[58] Field of Search ..... 102/202.14, 202.5, 102/202.12, 301, 331, 217

[56] References Cited

U.S. PATENT DOCUMENTS

| | | | |
|---|---|---|---|
| 721,431 | 2/1902 | Durham | 102/331 |
| 748,935 | 1/1904 | Durham | 102/331 |
| 1,493,921 | 5/1924 | De Blasio | 102/322 |
| 1,517,294 | 12/1924 | Kowastch | 206/3 |
| 3,244,103 | 4/1966 | Spickard | 102/202.5 |
| 4,306,499 | 12/1981 | Holmes | 102/202.4 |
| 4,498,391 | 2/1985 | Gergo et al. | 102/312 |
| 4,625,645 | 12/1986 | Williams | 102/202.4 |
| 4,762,067 | 8/1988 | Barker et al. | 102/313 |
| 5,070,789 | 12/1991 | True et al. | 102/275.12 |

*Primary Examiner*—Michael J. Carone
*Assistant Examiner*—Christopher K. Montgomery
*Attorney, Agent, or Firm*—Antonelli, Terry, Stout & Kraus

[57] ABSTRACT

A detonating system includes a detonator within a thermal insulating container. In order for the detonator, especially an electronic detonator, to be usable at higher temperatures, the detonator is surrounded by the thermal insulating container especially a Dewar vessel.

7 Claims, 1 Drawing Sheet

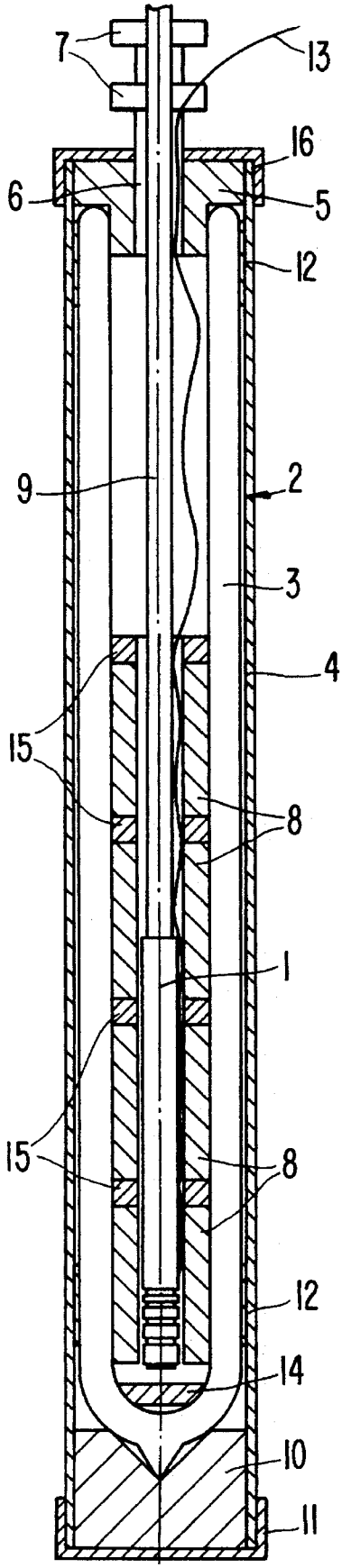
7
13
16
6
5
12
9
2
3
4
15
8
1
15
8
12
14
10
11

DETONATING SYSTEM HAVING A DETONATOR WITHIN AN INSULATING CONTAINER

BACKGROUND OF THE INVENTION

The invention relates to a detonating system having a detonator surrounded by a thermal insulating container which enables the system to operate at temperatures above 150° C.

Shaped charge perforator carrier systems (perforating systems) with electrical detonators are often used in the oilfield industry. These perforation systems consist of the electrical detonator, to which a primacord is connected, and the perforating hollow charges (perforators), which are detonated by the primacord. Perforators of this kind are used to perforate boreholes. Transmitters, radar systems, and other external voltage sources must be switched off during perforation to prevent premature triggering of the detonator and hence of the entire perforating system by parasitic currents. In order to avoid such expensive precautions relative to the safety of drilling rigs, electrical detonators have been developed that are not triggered by such parasitic (currents EBW (exploding bridge wire) and EFI (exploding foil initiator)) ignition systems.

These detonating systems are awkward to handle, are not very reliable, and have a limited temperature range in which they can be used. Detonating systems are triggered by voltages that cannot be generated without underground high-voltage generators. The triggering leads from the high-voltage generator are coaxial conductors of limited length. Hence, the entire system is very expensive.

Dynamit Nobel AG has developed an electronic detonator (DE-OS 34 40 016) which cannot be triggered inadvertently by parasitic currents. However, the detonator can only be used up to a temperature of 150° C. At higher temperatures the electronics are destroyed so that the detonator loses its ability to function.

SUMMARY OF THE INVENTION

An object of the present invention is to provide a detonating system having a detonator, especially an electronic detonator, which operates at higher temperatures as well.

This object is achieved according to the invention by virtue of the fact that the detonator is protected against the influence of temperature by a thermal insulating container (Dewar vessel). The detonator can then be used even at temperatures higher than 150° C., without the electronics being damaged. The insulating effect depends on the design of the container. A container has already been developed in which an internal temperature does not exceed 110° C. at an outside temperature of 250° C.

The detonating system is also generally suited for improving the temperatures at which electrical and nonelectrical detonators can be used.

According to the invention the detonator is advantageously an electronic detonator, as described for example in the above-mentioned DE-OS 34 40 016. Consequently, an electronic detonator that is insensitive to parasitic currents can be used at higher temperatures as well.

In one advantageous embodiment, the insulating container consists of a glass Dewar vessel or container with an external protective sheath and a sealing plug, possible with an upper lid. However, other Dewar type vessels can be used as well. The protective sheath is advantageously made of aluminum, so that the insulating container has a low weight, and can be transported to the site for use by aircraft without especially high costs being involved.

In a preferred embodiment, at least one hole with a fastening unit is located on the upper lid of the insulating container. A hole is also provided in the sealing plug that is aligned with the hole in the upper lid. The detonating cable and/or a PRIMACORD® (i.e. and/or a detonating cord) connected to the detonator is/are fastened to the fastening unit, so that the detonator cannot be pulled out of the insulating container by pulling on the detonator cables or on the detonating cord.

To ensure that the detonator inside the insulating container does not react immediately to a slight increase in temperature, the detonator is surrounded advantageously by a thermal buffer in the insulating container. According to the invention, the thermal buffer advantageously consists of copper rings, with the detonator located on the axis of symmetry of the copper rings. The copper rings are advantageously surrounded with shrink tubing to protect the glass Dewar vessel. The shrink tubing is a heat shrinkable plastic tube.

In a preferred embodiment, the detonator is used in the oilfield industry to trigger perforating systems for perforating boreholes. For this purpose a primacord is connected to the detonator, and brought out of the insulating container. For safety reasons, the detonator advantageously does not detonate upon contact with a liquid such as water.

BRIEF DESCRIPTION OF THE DRAWINGS

Further features of the invention will follow from an embodiment of the invention described in greater detail in the following description with reference to the accompanying drawing, wherein the sole FIGURE is a schematic sectional view of the detonating system of the invention.

DETAILED DESCRIPTION OF THE INVENTION

The FIGURE shows a thermal insulating container 2 according to the invention provided with a glass Dewar vessel 3, surrounded by an external protective sheath 4 made, for example, of a lightweight metal such as aluminum. The term "glass Dewar vessel" refers to a double-walled glass tube closed at one end, whose space between the double walls is evacuated. At its closed end, the glass Dewar vessel 3 is embedded in a retaining device 10, made of silicone rubber, for example, which completely fills the lower end of the external protective sheath 4. A lower lid 11, which surrounds the outer portion of the protective sheath 4, seals the latter. Lower lid 11 is fastened by gluing or shrink fitting, for example.

Glass Dewar vessel 3 abuts or adjoins the inside wall of the outer protective sheath 4 via two spacing rings 12 located at a distance from one another. At its open end, the glass Dewar vessel 3 is covered by a sealing plug 5, hereinafter referred to as a plug, with plug 5 consisting of an outer disk that abuts the end of the glass Dewar vessel 3 and completely fills the inside diameter of the outer protective sheath 4. An annular extension or portion of plug 5 projects into glass Dewar vessel 3 and fills the interior end of the glass Dewar vessel 3 completely. A hole 6 is located centrally in plug 5, and its significance will be described later. However, it can also be advantageous not to make plug 5 into one piece as shown. Plug 5 is made of silicone rubber, for example.

An upper lid 16 surrounds the upper end of outer protective sheath 4 and clamps the ends of glass Dewar vessel 3 between retaining device 10 and plug 5. Upper lid 16, like plug 5, has a hole which is located above and aligned with the hole in plug 5. Upper lid 16 is fastened to the sheath 4 by gluing or shrink fitting, for example.

A fastening means or bracket 7 made of aluminum, for example, is also mounted on the upper lid 16, said bracket consisting of a rib disposed in the lengthwise direction of the insulating container 2, on which rib bendable tabs are provided. Detonating cable 13 and/or a detonating cord 9 can be secured by means of these bendable tabs.

An insert 14 (made of polyethylene) is placed on the bottom of glass Dewar 3 for protection. Above this insert 14, is an electronic detonator 1, with two detonator cables 13 being brought out at its end directed downward. The FIGURE, however, shows only one detonating cable 13. At the opposite end of detonator 1, a detonating cord 9 is connected by means of a mounting sleeve. Detonator cables 13 and primacord 9 are brought out of insulating container 2 through hole 6 and the hole in upper lid 16 above the plug. The cables and the detonating cord can be clamped firmly with the tabs of fastening means 7 so that the detonator cannot be pulled out of the insulating container by pulling on detonator cables 13 or on detonating cord 9.

To increase the heat capacity inside glass vessel Dewar 3, copper rings 8 are provided around detonator 1 or a portion of detonating cord 9 as heat buffers. These copper rings 8 are connected with one another or covered by spacing rings 15. Spacing rings 15 advantageously consist of soft foam, polyethylene, (PE) for example, to minimize the heat transfer between the individual copper rings 8.

Hole 6 in plug 5 and the hole above it in upper lid 16 must have a diameter larger than detonator 1, so that the latter can be slid into insulating container 2. In order to keep the amount of heat added as low as possible, these holes should be only slightly larger, however.

The detonating cord 9 shown here triggers perforators used in the oilfield industry for perforating boreholes. Thermal insulating container 2 is destroyed by the detonation of the detonator during the triggering of the perforating system.

What is claimed is:

1. A detonating system comprising a triggering mechanism used in an oilfield for triggering perforated systems for perforating boreholes, said triggering mechanism including a detonator surrounded by a thermal insulating container, said detonator comprising an electronic detonator which is operative at temperatures up to 150° C., said insulating container comprising Dewar vessel having an open end positioned within an external protective sheath, a sealing plug for closing the open end of the Dewar vessel and an upper lid for closing an open end of the external protective sheath; said sealing plug and said upper lid each being provided with at least one opening for allowing entry of a detonating cord which is connected to the detonator and said detonating cord extending out of the insulating container.

2. A detonating system comprising a detonator surrounded by a thermal insulating container, said detonator comprising an electronic detonator which is operative at temperatures up to 150° C., said insulating container comprising Dewar vessel having an open end positioned within an external protective sheath, a sealing plug for closing the open end of the Dewar vessel and an upper lid for closing an open end of the external protective sheath; said sealing plug and said upper lid each being provided with at least one opening for allowing entry of a detonating cord which is connected to the detonator and said detonating cord extending out of the insulating container.

3. A detonating system according to claim 2, wherein the protective sheath is made of aluminum.

4. A detonating system according to claim 2, wherein a fastening means is provided on the upper lid.

5. A detonating system according to claim 2, wherein the detonator is surrounded by a thermal buffer located within the insulating container.

6. A detonating system according to claim 5, wherein the thermal buffer consists of a plurality of copper rings.

7. A detonating system according to claim 2, wherein said Dewar vessel is a vessel made of glass and wherein an insert made of plastic is placed on a bottom of the glass vessel to support a lower end of the detonator and to protect the glass vessel and a retaining element of silicon rubber is provided at a closed end of the glass vessel to separate the vessel from the external protective sheath.

* * * * *